United States Patent [19]

Hozer et al.

[11] Patent Number: 4,891,922

[45] Date of Patent: Jan. 9, 1990

[54] TOP CAP FOR PANEL

[75] Inventors: James S. Hozer, Muskegon; Robert L. Gonder, Holland, both of Mich.

[73] Assignee: Haworth, Inc., Holland, Mich.

[21] Appl. No.: 290,241

[22] Filed: Dec. 23, 1988

[51] Int. Cl.[4] ..... A47G 5/00; E04F 19/06

[52] U.S. Cl. ..... 52/239; 52/36; 52/238.1; 52/717.1; 160/135; 160/351

[58] Field of Search ..... 52/36, 220, 221, 71, 52/238.1, 239, 241, 282, 716, 717, 718; 160/135, 351, 392–397

[56] References Cited

U.S. PATENT DOCUMENTS

| | | | |
|---|---|---|---|
| 3,768,222 | 10/1973 | Birum, Jr. | 52/239 |
| 3,871,153 | 3/1975 | Birum, Jr. | 52/239 X |
| 4,047,342 | 9/1977 | Boulva | 52/239 |
| 4,104,838 | 8/1978 | Hage et al. | 52/239 |
| 4,112,643 | 9/1978 | Decker | 160/135 X |
| 4,213,493 | 7/1980 | Haworth | 160/351 |
| 4,416,093 | 11/1983 | Salkeld et al. | 160/135 X |
| 4,611,448 | 9/1986 | DeLong | 52/239 |
| 4,631,881 | 12/1986 | Charman | 160/135 X |
| 4,716,698 | 1/1988 | Wilson et al. | 52/239 |

*Primary Examiner*—Richard E. Chilcot, Jr.

*Attorney, Agent, or Firm*—Flynn, Thiel, Boutell & Tanis

[57] ABSTRACT

An upright panel having an upwardly-opening top channel extending along the upper edge, which channel is closed off by a top cap. Spring retainers releasably engage the underside of the top cap, and in turn releasably secure the top cap to the panel. Each spring retainer has sidewardly-spaced upwardly cantilevered spring legs which have hooks for engagement within retaining channels provided on the underside of the top cap. An arched spring part extends sidewardly between the spring legs adjacent the lower ends thereof. This arched part is normally positioned downwardly from the underside of the top cap. Sidewardly-spaced downwardly cantilevered spring legs extend downwardly from the upper spring legs, and at their lower ends have sidewardly projecting cams which project under the channel top flanges. During removal of the top cap, the upper and lower spring legs initially jointly deflect inwardly about the top hooks, and this causes resilient deflection of the arched part until it abuts the top cap. Further removal of the top cap causes the lower spring legs to resiliently deflect inwardly about the ends of the arched spring part, while the retainer remains securely engaged with the top cap.

8 Claims, 2 Drawing Sheets

TOP CAP FOR PANEL

FIELD OF THE INVENTION

This invention relates to a structure for securing a top cap to the upper edge of a space-dividing wall panel and, more particularly, to an improved dual-rate spring retainer for releasably securing the top cap to the panel.

BACKGROUND OF THE INVENTION

Interior space-dividing wall panels are extensively utilized in offices and the like to divide large areas into smaller working areas. Such panels conventionally have an interior framework provided with either hard or soft coverings on opposite sides thereof, with the panel conventionally having trim rails releasably attached to the opposite vertical edges, and a top cap releasably attached to the upper edge. The top cap has generally been secured to the top rail of the interior framework by various types of spring clips.

For example, in one known panel, the top rail of the panel frame has been provided with several spring-type retainers secured thereto at longitudinally spaced intervals. These retainers are fixed to the top rail and extended thereacross so as to permit the top rail to be releasably but securely mounted on the top of the panel. With this arrangement, however, the retainers remained secured to the top rail and extended thereacross, and hence are undesirable in those situations where it is desirable to utilize the top rail as a hollow channel for accommodating communication or power cables since such retainers interfere with the laying-in of cables in the top cap.

Other known panels have attempted to use a top cap wherein the retainer is mounted directly to the top rail. These known structures, however, have generally required that the retainers be fixedly secured to the top cap, such as by welding or other suitable means, and have increased the cost of manufacturing the system. Further, most of these retainers have utilized some type of one-way retaining structure, such as a Christmas tree type spring retainer, and hence such retainers are not readily releasable or reusable.

Accordingly, it is an object of this invention to provide an improved retainer for securing a top cap to an interior space-dividing wall panel, which retainer overcomes many of the disadvantages associated with the prior known structures.

More specifically, the present invention relates to an improved spring-type retainer adapted for releasably attaching a top cap to a wall panel, which retainer is detachable both from the top cap and the panel to facilitate the manufacture, shipping and installation of the overall arrangement. At the same time, this improved retainer cooperates with the top cap and the panel top rail in a manner so as to function on a dual-rate spring principle so that, during removal of the top cap from the panel, the retainer remains securely attached to the top cap so as to be removable therewith, thereby providing free access into the top rail of the panel throughout the complete longitudinal length thereof.

In the improved arrangement of this invention, the retainer is formed generally in one piece and includes upwardly cantilevered spring legs which hook into opposed channels formed on the underside of the top cap to secure the retainer to the top cap. These sidewardly-opposed spring legs are joined together by a generally inverted V-shaped spring which bridges between the sidewardly-opposed spring legs but is normally disposed downwardly out of engagement with the top cap. The retainer also has downwardly cantilevered spring legs which have sidewardly projecting flanges adjacent the lower end thereof having both upper and lower camming surfaces thereon. These flanges are adapted to resiliently move into a position below the top flanges associated with the panel top rail to downwardly secure both the retainer and the top cap against the panel. When removal of the top cap is desired, the upper and lower spring legs are initially resiliently deflected inwardly about the points of engagement between the upper legs and the top cap due to the camming effect of the lower flanges against the top rail flanges. This in turn causes the V-shaped spring bridge to deflect upwardly until the apex abuts the under surface of the top cap. This effectively locks the upper spring legs into engagement with the top cap. The lower legs thereafter resiliently deflect inwardly about new fulcrum points disposed substantially at the junctions of the legs with the V-shaped bridge, whereby the lower legs then have a higher spring rate and, in response to upper lifting of the top cap, deflect inwardly to release the retainer and the top cap from securement to the top rail. Once removed from the panel, the lower legs of the retainer can be easily resiliently deformed outwardly away from one another to cause the upper legs to be deflected inwardly toward one another to release the retainer from the top cap.

Other objects and purposes of the invention will be apparent to persons familiar with structure of this general type upon reading the following specification and inspecting the accompanying drawings.

Figure 1:
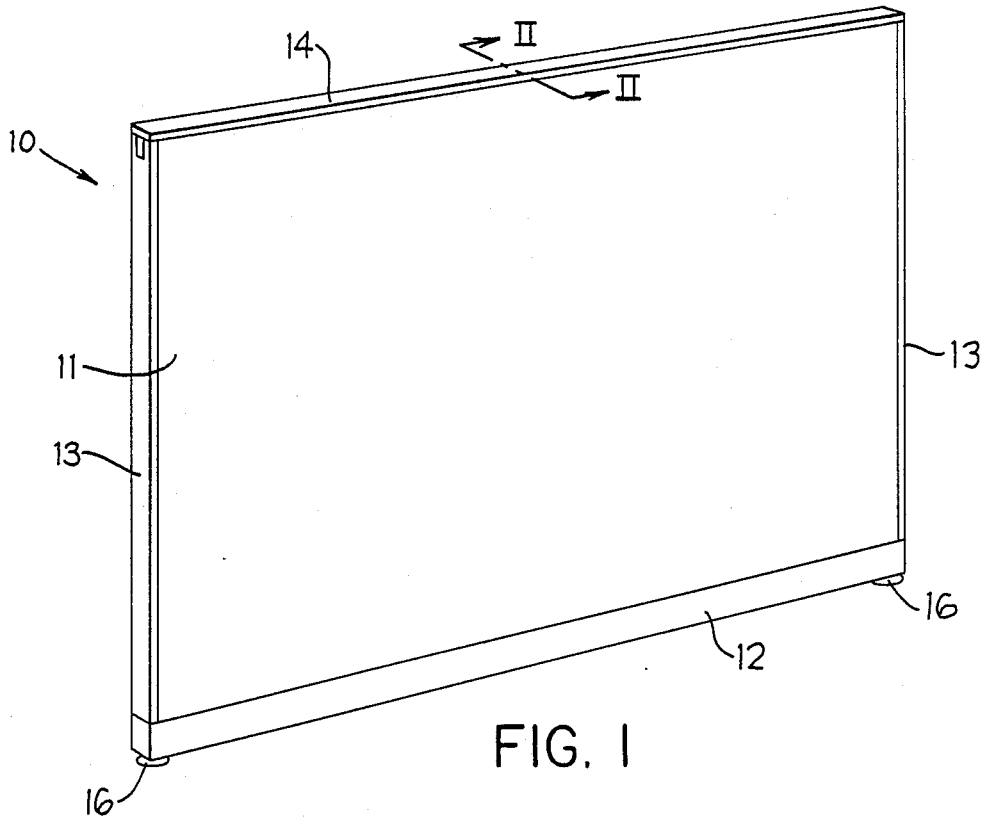
FIG. 1 diagrammatically illustrates an interior space-dividing wall panel.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the structure and designated parts thereof. Said terminology will include the words specifically mentioned, derivatives thereof, and words of similar import.

DETAILED DESCRIPTION

Figure 2:
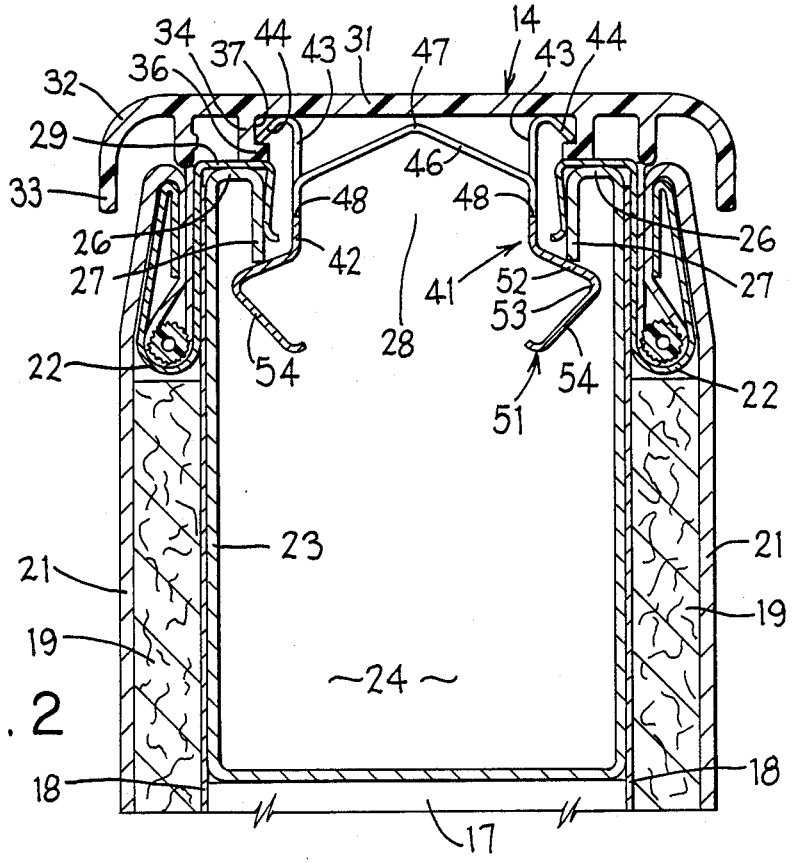
FIG. 2 is an enlarged, fragmentary sectional view taken substantially along II—II in FIG. 1 and illustrating the securement of the top cap to the top rail of the panel.
Figure 3:
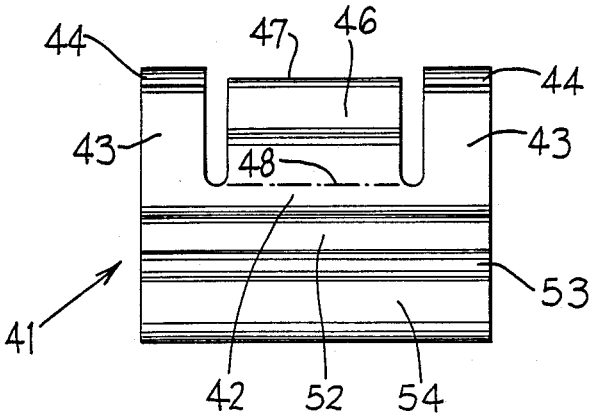
FIG. 3 is a side or longitudinal view of solely the spring retainer.

FIG. 1 illustrated a known type of interior space-dividing wall panel 11 such as used in offices and the like. Such panel typically has a base rail or channel 12 extending along the lower edge thereof, trim rails 13 extending along the vertical edges thereof for permitting several such panels to be joined together in series, and a top cap 14 releasably secured to the panel so as to extend longitudinally along the upper edge thereof. The panel is typically provided with adjustable glides or feet 16 for support on the floor. The panel 11, as illustrated by FIG. 2, typically includes a core structure 17, such as a honeycomb arrangement, which core is secured between a pair of side skins 18, the latter preferably being thin metal sheets. The skins 18 in turn are provided with outer coverings which, in the illustrated embodiment, comprise sound-absorbing fiberglass layers 19 which are covered by outer fabric coverings 21. The edges of the fabric covering 21 are secured by fabric retainers 22 which attach to the edges of the panel framework.

The panel framework typically includes channels or similar structural members which extend along each of the horizontal and vertical edges of the panel between the skins 18, and one such channel 23 extends longitudinally along the top edge of the panel. This top channel 23, in the preferred embodiment, defines therein an upwardly opening compartment 24 which can desirably be utilized for storing and routing of communication and/or power cables. The top channel 23 has inwardly directed top flanges which include inwardly directed top flange portions 26 which in turn join to downwardly directed flange portions 27, the latter terminating in free edges which function as shoulders for cooperation with the spring retainer, as defined hereinafter. These flanges 26–27 define therebetween a mouth or opening 28 which provides access to the compartment 24. This mouth 28 opens upwardly throughout the longitudinal length of the panel. The fabric retainers 22 have a downwardly-opening channel-like flange 29 which hooks over the flanges 26–27 to secure the fabric retainer in place.

The top cap 14 is designed for effectively closing off the top of the panel and improving the general appearance of the panel. For this purpose, the top cap 14 is of shallow vertical profile and includes a generally flat top wall 31 which extends generally throughout the length of the panel and, along the opposite side edges thereof, merges into downwardly rounded corners 32. These rounded corners 32 are of a generally 90° radius and join to downwardly-projecting vertical edge flanges 33, the latter being of short vertical extent. In fact, these edge flanges 33 project downwardly so as to only slightly vertically overlap the side fabrics 21 to provide a more desirable appearance. The horizontal spacing between the sidewardly-spaced side flanges 33 approximately corresponds to the overall width of the panel.

The top cap 14 also has a pair of generally parallel and sidewardly-spaced support ribs 34 associated therewith, which ribs 34 project vertically downwardly from the top wall 31. These support ribs 34 extend longitudinally throughout the length of the top cap an, at their lower ends, terminate in inwardly directed feet 36 which are adapted to abuttingly engage the upper wall of the retainer flange 29 to create a direct support on the flanges 26–27 of the top channel 23. These support ribs 34 and their inwardly directed feet 36 result in the defining of shallow channels 37 which extend longitudinally of the top cap and open sidewardly in inwardly opposed relationship to one another.

To securely but releasably attach the top cap 14 to the panel, the top cap 14 is provided with several (such as two or more) spring retainers 41 releasably attached to the underside thereof at longitudinally spaced intervals therealong. The spring retainer 41 is adapted to be releasably attached to the underside of the top cap 14, and at the same time can thereafter be releasably but securely engaged with the top channel 23 of the panel to securely retain the top cap on the panel. However, the spring retainer is designed such that, when removal of the top cap is desired, the retainer will remain attached to the top cap so that full access to the compartment 24 is possible throughout the complete longitudinal length of the panel.

Considering now the specific structural and functional relationships of the retainer 41, it includes generally parallel side plates 42 which are spaced a significant distance apart, but which distance is somewhat smaller than the sideward spacing between the flanges 27. The side plates 42 adjacent the opposite longitudinal ends thereof, have cantilevered spring legs 43 projected upwardly therefrom in generally coplanar relationship therewith. These spring legs 43 at their upper ends are provided with locking flanges 44 which are bent outwardly and sloped downwardly so as to terminate in free edges. The locking flanges 44 as associated with the upwardly cantilevered spring legs 43 are adapted to seatingly engage within the shallow channels 37 defined by the top cap support ribs 34.

The retainer 41 also has a generally inverted V-shaped spring part 46 which joins or bridges between the side plates 42. This V-shaped spring part 46 is disposed longitudinally between the sidewardly opposed pairs of spring legs 43, and has its apex 47 disposed uppermost at an elevation which is normally (that is, when the spring retainer is in a relaxed or nonstressed condition) below the uppermost point of the spring legs 43. Further, even when the spring retainer 41 is in a stressed or resiliently deflected condition wherein it secures the top cap 14 to the top channel 23 as illustrated by FIG. 2, this apex 47 is still spaced downwardly a small distance from the undersurface of the top cap so as to be out of engagement therewith. This V-shaped spring part has the legs thereof joined to the side plates 42 substantially at junction or fulcrum points 48, which fulcrum points 48 are located intermediate the vertical extent of the planar portions which define the side plates 42 and the spring legs 43.

The spring retainer 41 also includes a pair of sidewardly-opposed spring legs which are downwardly cantilevered for effecting releasable securement of the retainer to the top channel 23. These downwardly cantilevered spring legs are formed by the side plates 42 and by the sidewardly directed securing flanges 51 which are integrally formed at the lower ends of the side plates 42. The securing flanges 51 are of a generally V-shaped configuration which is sidewardly oriented so that the flange projects outwardly relative to its respective side plate 42. Each flange 51 includes a top flange or cam 52 which is joined to the side plate 42 and which projects sidewardly outwardly as it slopes downwardly. This top cam 52 projects to an apex 53, at which point it joins to a bottom cam 54 which extends generally transversely relative to the cam 52 in that the cam 54 projects sidewardly inwardly as it slopes downwardly until terminating at a free edge. The sideward dimension between the apexes 57 of the opposed flanges 51, when the retainer is mounted on the top rail 23, is significantly greater than the width of the mouth 28.

The retainer 41 is preferably integrally formed in one piece from a single sheet of thin spring steel. To facilitate the attachment of the top cap 14 to the panel, several spring retainers are initially secured to the top cap. For example, one spring retainer is preferably secured to the top cap adjacent each end thereof, and if the top cap is of significant length, then a third retainer will normally be secured to the top cap substantially at the midpoint.

To secure the retainer 41 to the top cap 14, the retainer is disposed so that the flanges 44 are disposed directly adjacent the feet 36 of the support ribs. By then pushing the retainer inwardly toward the top cap, the slope of the flanges 44 reacts against the feet 36 and cams the spring legs 43 inwardly to that the flanges 44 can pass between the feet 36, following which the spring legs 43 resiliently deflect outwardly and cause the flanges 44 to lock into the shallow channels 37. If necessary or desirable, the installer can also grasp the flanges 51 and resiliently deflect them outwardly away from one another while simultaneously pushing the retainer toward the top cap, since this also will assist in moving flanges 44 inwardly toward one another to facilitate the installation of the retainer 41 on the top cap 14.

After the retainer was been mounted on the top cap, substantially as illustrated by FIG. 1, the legs 43 will be maintained in a slightly inwardly resiliently deflected condition since the sideward spacing between the bottom walls of the channels 37 is preferably slightly less than the maximum dimension between the tips of the flanges 44 when the retainer 41 is in a nonstressed or nondeflected condition. This slight stressing or resilient deflection of the retainer, when mounted on the top cap, assists in securely maintaining the retainer on the top cap, particularly at the desired position along the top cap.

Thereafter the top cap is positioned directly over the top channel 23 and is then forcibly moved downwardly to attach the top cap to the panel. During this downward attaching operation, the lower cams 54 react against the flanges 26, 27 and 29 and are resiliently deflected inwardly to a sufficient extent so as to enable the flanges 51 to then be pushed downwardly through the mouth 28 of the top channel 23. After passing through the mouth, the flanges 51 are resiliently returned outwardly so that the upper cams 52 are disposed below the flanges 27. The natural tendency of the flanges 51 to deflect outwardly in an attempt to return to their natural position, coupled with the slope of the top cams 52 and the manner in which they react against the bottom of the flanges 27, causes the top cap 14 to be snugly moved downwardly so that the support ribs 34 are securely seated against the top flanges of the top channel 23.

When removal of the top cap is desired, a lifting force is applied to the top cap, such as at the end thereof. This lifting force is transmitted to the retainer 41 so that the retainer is also lifted upwardly. During initial upward lifting, the cams 52 slidably cam against the lower edges of the flanges 27 and cause the flanges 51 to be resiliently deflected inwardly. This inward deflection of flanges 51 initially occurs at a lower spring rate since the flanges 51 initially deflect inwardly about fulcrum points defined by the free edge of the flange 44 and their contact with the support ribs 34. Thus, the legs 43 and the side plates 42 effectively act as an elongate spring leg which is initially deflected inwardly This inward deflection, however, also causes compression of the V-shaped spring part 46 so that the apex 47 thereof raises upwardly until contacting the underside of the top cap 14. When this contact of the apex 47 with the top cap 14 occurs, then this results in a rigidification of the V-shaped spring part 46, whereby string part 46 and the upwardly-cantilevered spring legs 43 are now effectively coupled together as a generally rigid structure, and the spring legs 43 are thus securely coupled to the top cap 14. Further upward lifting of the top cap and of the retainer 41 continues to cause the flanges 51 to be resiliently deflected inwardly due to the camming caused by upper cams 52. However, this inward resilient deflection now occurs solely about the lower cantilevered legs, that is substantially about the fulcrum points 48. Since these fulcrum points 48 are at a substantially lower elevation, the length of these lower cantilevered spring legs is significantly reduced so that there is provided a much higher spring rate, and thus a greater force is required to effect inward resilient camming of the flanges 51 so as to effect complete release thereof from the flanges 27 of the top channel 23. Once this release has been accomplished, however, the top cap 14 and the retainers 41 carried thereon can then be wholly removed from the panel.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an upright space-dividing wall assembly including an upright panel having an upwardly-opening top channel extending longitudinally along an upper edge thereof, a horizontally elongated top cap releasably mounted on the upper edge of said panel for closing off said top channel, and a resilient retainer coacting between said top cap and said panel for releasably securing said top cap to said panel, the improvement comprising:

said top channel having top flanges which extend longitudinally therealong and which project inwardly toward one another from opposite sides thereof;

said top cap having a pair of sidewardly-spaced support ribs projecting downwardly therefrom and extending longitudinally therealong, each said support rib defining therein a retaining channel which opens sidewardly toward the other support rib; and said retainer including (1) a sidewardly-spaced pair of upwardly cantilevered spring legs which at their upper free ends terminate in sidewardly-directed retaining flanges which engage within the respective retaining channels, (2) an upwardly-arched spring part joined between said upwardly cantilevered spring legs adjacent the lower ends thereof, said arched spring part having a middle part which is spaced upwardly from the lower ends of said upwardly cantilevered spring legs and which is normally positioned close to but spaced downwardly a small distance from an undersurface of said top cap, and (3) a sidewardly-spaced pair of downwardly cantilevered spring legs which project downwardly from said spring part and terminate in sidewardly outwardly projecting camming flanges which resiliently project under the top flanges of said top channel.

2. A wall assembly according to claim 1, wherein said camming flanges are of a generally V-shaped configuration which is sidewardly directed so that the apex of the V-shaped configuration is disposed outermost, said V-shaped configuration including a top cam which slopes downwardly as it projects outwardly until reaching the apex, and a bottom flange which projects inwardly from the apex and simultaneously slopes downwardly sc as to terminate at a free edge.

3. A wall assembly according to claim 2, wherein the retaining flanges are joined to the upper ends of the upwardly cantilevered spring legs and project sidewardly outwardly and downwardly therefrom so as to terminate in a free edge.

4. A wall assembly according to claim 3, wherein said arched spring part is of a generally inverted V-shaped configuration having an apex defining the uppermost part, said apex being spaced substantially midway between the sidewardly-spaced spring legs and normally spaced downwardly a small distance from the underside of the top cap.

5. A wall assembly according to claim 4, wherein the retainer is constructed in one piece from sheet-like spring steel.

6. A wall assembly according to claim 1, wherein said upwardly cantilevered and downwardly cantilevered spring legs are generally coplanar when in a nondeflected condition, and wherein the arched spring part is of a generally inverted V-shaped configuration as it extends sidewardly between the sidewardly-opposed spring legs, said V-shaped spring part having the sidewardly-spaced ends thereof integrally joined to the spring legs at an elevation which is disposed vertically between the retaining flanges and the camming flanges.

7. A wall assembly according to claim 6, wherein the retainer is constructed in one piece from sheet-like spring steel.

8. A wall assembly according to claim 7, wherein said camming flanges are of a generally V-shaped configuration which is sidewardly directed so that the apex of the V-shaped configuration is disposed outermost, said V-shaped configuration including a top cam which slopes downwardly as it projects outwardly until reaching the apex, and a bottom flange which projects inwardly from the apex and simultaneously slopes downwardly so as to terminate at a free edge.

* * * * *